US009797294B2

(12) United States Patent
Yin et al.

(10) Patent No.: US 9,797,294 B2
(45) Date of Patent: Oct. 24, 2017

(54) INTELLIGENT SEA WATER COOLING SYSTEM

(71) Applicant: IMO Industries, Inc., Hamilton, NJ (US)

(72) Inventors: Dan Yin, Waxhaw, NC (US); Stefan Werner, Allensbach (DE); David McKinstry, Charlotte, NC (US); Edwin Braun, Allensbach (DE); Christian Martin, Radolfzell (DE); Martin Hoffmann, Moos (DE); Christian Hopf, Mullhausen-Ehingen (DE); Alistair Baird, Saunderstown, RI (US)

(73) Assignee: IMO Industries Inc., Hamilton, NJ (US)

( * ) Notice: Subject to any disclaimer, the term of this patent is extended or adjusted under 35 U.S.C. 154(b) by 0 days.

(21) Appl. No.: 14/785,549

(22) PCT Filed: Apr. 9, 2014

(86) PCT No.: PCT/US2014/033422

§ 371 (c)(1),
(2) Date: Oct. 19, 2015

(87) PCT Pub. No.: WO2014/172153

PCT Pub. Date: Oct. 23, 2014

(65) Prior Publication Data

US 2016/0076434 A1 Mar. 17, 2016

Related U.S. Application Data

(60) Provisional application No. 61/813,822, filed on Apr. 19, 2013.

(51) Int. Cl.
*F01P 7/16* (2006.01)
*F01P 3/20* (2006.01)
(Continued)

(52) U.S. Cl.
CPC ..... *F01P 7/164* (2013.01); *B63H 21/10* (2013.01); *F01P 3/207* (2013.01); *B63H 21/383* (2013.01); *F01P 2050/06* (2013.01)

(58) Field of Classification Search
CPC ..... F01P 3/207; F01P 7/16; F01P 3/20; F01P 2031/00; F01P 2050/06; F01P 3/202; F01P 5/14; F01P 7/164
See application file for complete search history.

(56) References Cited

U.S. PATENT DOCUMENTS 4,726,325 A * 2/1988 Itakura ..... F01P 7/048 123/41.1
5,004,042 A 4/1991 McMorries, IV et al.
(Continued)

FOREIGN PATENT DOCUMENTS

DE 217274 A1 1/1985
FR 1237044 A 7/1960
(Continued)

OTHER PUBLICATIONS

International Search Report dated Aug. 27, 2014 for PCT Application PCT/US2014/033422 filed Apr. 9, 2014.
Supplemental European Search Report mailed Dec. 6, 2016 for corresponding European Patent Application 14784652.

*Primary Examiner* — Hai Huynh
*Assistant Examiner* — Long T Tran

(57) ABSTRACT

An intelligent sea water cooling system including a first fluid cooling loop coupled to a heat exchanger, a second fluid cooling loop coupled to the heat exchanger and including a fluid pump for circulating fluid through the second fluid cooling loop, and a controller operatively connected to the fluid pump. The controller may be configured to monitor an actual temperature in the first fluid cooling loop and to adjust
(Continued)

a speed of the fluid pump based on the monitored temperature in order to achieve a desired temperature in the first fluid cooling loop.

12 Claims, 9 Drawing Sheets

(51) Int. Cl.
*B63H 21/10* (2006.01)
*B63H 21/38* (2006.01)

(56) References Cited

U.S. PATENT DOCUMENTS

| | | | | |
|---|---|---|---|---|
| 5,599,217 | A | 2/1997 | Ferrante | |
| 6,739,290 | B2 | 5/2004 | Iwasaki et al. | |
| 6,955,141 | B2 | 10/2005 | Santanam et al. | |
| 8,602,117 | B2 * | 12/2013 | Janik | A62C 3/10 169/13 |
| 2012/0097118 | A1 | 4/2012 | Malmgren et al. | |

FOREIGN PATENT DOCUMENTS

| | | | | |
|---|---|---|---|---|
| JP | H08100772 | A | | 4/1996 |
| JP | H09-79036 | A | | 3/1997 |
| JP | 2000145651 | A | | 5/2000 |
| JP | 2004225672 | A | | 8/2004 |
| JP | 2011-122771 | A | | 6/2011 |
| JP | 2012-122371 | A | | 6/2012 |
| JP | 201406910 | A | * | 3/2014 |
| JP | 2014046910 | A | * | 3/2014 |
| KR | 10-2010-0080566 | A | | 8/2010 |

* cited by examiner

INTELLIGENT SEA WATER COOLING SYSTEM

CROSS-REFERENCE TO RELATED APPLICATIONS

This application is related to and claims priority from U.S. Provisional Patent Application No. 61/813,822, filed on Apr. 19, 2013, by Daniel Yin, et al., entitled: "Intelligent Sea Water Cooling System", which is incorporated herein by reference in its entirety.

FIELD OF THE DISCLOSURE

The disclosure is generally related to the field of sea water cooling systems for seafaring vessels, and more particularly to a system and method for controlling the temperature in a fresh water cooling loop by regulating pump speed in a sea water cooling loop thermally coupled thereto.

BACKGROUND OF THE DISCLOSURE

Large seafaring vessels are commonly powered by large internal combustion engines that require continuous cooling under various operating conditions, such as during high speed cruising, low speed operation when approaching ports, and full speed operation for avoiding bad weather, for example. Existing systems for achieving such cooling typically include one or more pumps that draw sea water into heat exchangers onboard a vessel. The heat exchangers are used to cool a closed, fresh water cooling loop that flows through and cools the engine(s) of the vessel and/or other various loads onboard the vessel (e.g., air conditioning systems).

A shortcoming that is associated with existing sea water cooling systems such as the one described above is that they are generally inefficient. Particularly, the pumps that are employed to draw sea water into such systems are typically operated at a constant speed regardless of the amount of sea water necessary to achieve sufficient cooling of the associated engine. Thus, if an engine does not require a great deal of cooling, such as when the engine is idling or is operating at low speeds, or if the sea water being drawn into a cooling system is very cold, the pumps of the cooling system may provide more water than is necessary to achieve sufficient cooling. In such cases, the cooling system will be configured to divert an amount of the freshwater in the freshwater loop directly to the discharge side of the heat exchangers, where it mixes with the rest of the freshwater that flowed through, and was cooled by, the heat exchangers. A desired temperature in the freshwater loop is thereby achieved. However, the system does not require the full cooling power provided by sea water pumps driven at constant speed (hence the need to divert water in the fresh water loop). A portion of the fuel expended in driving the pumps is therefore unnecessary. Thus, there is a need for a more efficient sea water pumping system for use in heat exchange systems servicing the marine industry.

SUMMARY

In view of the foregoing, it would be advantageous to provide an intelligent sea water cooling system and method that provide improved efficiency and fuel savings relative to existing sea water cooling systems and methods.

An exemplary system in accordance with the present disclosure may include a first fluid cooling loop coupled to a heat exchanger, a second fluid cooling loop coupled to the heat exchanger and including a pump for circulating fluid through the second fluid cooling loop, and a controller operatively connected to the fluid pump. The controller may be configured to monitor an actual temperature in the first fluid cooling loop and to adjust a speed of the pump based on the monitored temperature in order to achieve a desired temperature in the first fluid cooling loop.

A method is disclosed for providing variable sea water cooling flow to a heat exchange element. The method comprises: circulating a first fluid in a first cooling loop at a first flow rate, the first cooling loop coupled to a first side of a heat exchanger; circulating a second fluid in a second cooling loop at a second flow rate, the second cooling loop coupled to a second side of the heat exchanger; detecting a temperature of the first fluid; and adjusting the second flow rate to maintain a temperature of the first fluid within a predetermined temperature range.

BRIEF DESCRIPTION OF THE DRAWINGS

By way of example, specific embodiments of the disclosed device will now be described, with reference to the accompanying drawings, in which.

DETAILED DESCRIPTION

Figure 1:
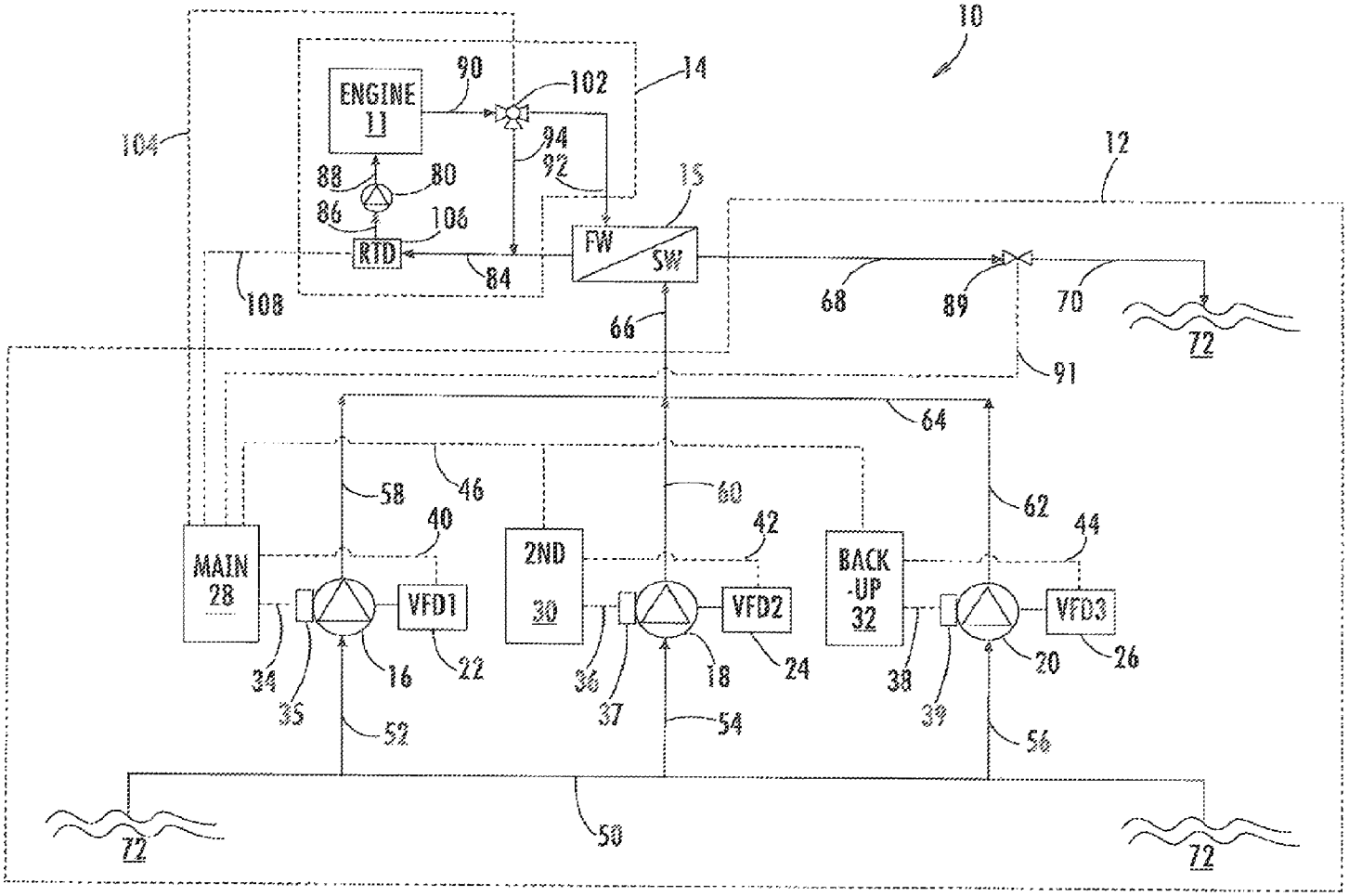
FIG. 1 is a schematic view illustrating an exemplary intelligent sea water cooling system in accordance system.

An intelligent sea water cooling system and method in accordance with the present disclosure will now be described more fully hereinafter with reference to the accompanying drawings, in which preferred embodiments of the invention are shown. The disclosed system and method, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

Referring to FIG. 1, a schematic representation of an exemplary intelligent sea water cooling system 10 (hereinafter "the system 10") is shown. The system 10 may be installed onboard any type of seafaring vessel or offshore platform having one or more engines 11 that require cooling. Only a single engine 11 is shown in FIG. 1, but it will be appreciated by those of ordinary skill in the art the engine 11 may be representative of a plurality of engines or various other loads onboard a vessel or platform that may be coupled to the cooling system 10.

The system 10 may include a sea water cooling loop 12 and a fresh water cooling loop 14 that are thermally coupled to one another by a heat exchanger 15 as further described below. Only a single heat exchanger 15 is shown in FIG. 1, but it is contemplated that the system 10 may alternatively include two or more heat exchangers for providing greater thermal transfer between the sea water cooling loop 12 and the fresh water cooling loop 14 without departing from the present disclosure.

The sea water cooling loop 12 of the system 10 may include a main pump 16, a secondary pump 18, and a backup pump 20. The pumps 16-20 may be driven by respective variable frequency drives 22, 24, and 26 (hereinafter "VFDs 22, 24, and 26"). The pumps 16-20 may be centrifugal pumps, but it is contemplated that the system 10 may alternatively or additionally include various other types of fluid pumps.

The VFDs 22-26 may be operatively connected to respective main, secondary, and backup controllers 28, 30, and 32 via communications links 40, 42, and 44. Various sensors and monitoring devices 35, 37, and 39, including, but not limited to, vibration sensors, pressure sensors, bearing temperature sensors, and other possible sensors, may be operatively mounted to the pumps 16, 18 and 20 and connected to the corresponding controllers 28, 30 and 32 via the communications links 34, 36, and 38. These sensors may be provided for monitoring the health of the pumps 16, 18, and 20 as further described below.

The controllers 28-32 may further be connected to one another by communications link 46. The communication link 46 may be transparent to other networks, providing supervising communication capability. The controllers 28-32 may be configured to control the operation of the VFDs 22-26 (and therefore the operation of the pumps 16-20) to regulate the flow of sea water to the heat exchanger 15 as further described below. The controllers 28-32 may be any suitable types of controllers, including, but not limited to, proportional-integral-derivative (PID) controllers and/or a programmable logic controllers (PLCs). The controllers 28-32 may include respective memory units and processors (not shown) that may be configured to receive and store data provided by various sensors in the cooling system 10, to communicate data between controllers and networks outside of the system 10, and to store and execute software instructions for performing the method steps of the present disclosure as described below.

The communications links 34-46, as well as communications links 81, 104 and 108 described below, are illustrated as being hard wired connections. It will be appreciated, however, that the communications links 34-46, 91, 104 and 108 of the system 10 may be embodied by any of a variety of wireless or hard-wired connections. For example, the communication links 34-46, 91, 104 and 108 may be implemented using Wi-Fi, a Bluetooth, PSTN (Public Switched Telephone Network), a satellite network system, a cellular network such as, for example, a GSM (Global System for Mobile Communications) network for SMS and packet voice communication, General Packet Radio Service (GPRS) network for packet data and voice communication, or a wired data network such as, for example, Ethernet/Internet for TCP/IP, VOIP communication, etc.

The sea water cooling loop 12 may include various piping and piping system components ("piping") 50, 52, 54, 56, 58, 60, 62, 64, 66, 68, 70 for drawing water from the sea 72, through the pumps 16-20, and for circulating the sea water through the sea water cooling loop 12, including a seawater side of the heat exchanger 15, as further described below. The piping 50-70, as well as piping 84, 86, 88, 90, 92, and 94 of the fresh water cooling loop 14 described below, may be any type of rigid or flexible conduits, pipes, tubes, or ducts that are suitable for conveying water, and may be arranged in any suitable configuration aboard a vessel or platform as may be appropriate for a particular application.

The sea water cooling loop 12 may further include a discharge valve 89 disposed intermediate the conduits 68 and 70 and connected to the main controller 28 via communications link 91. The discharge valve 89 may be adjustably opened and closed to vary the operational characteristics (e.g., pressure) of the pumps 16-20 as further described below. In one non-limiting exemplary embodiment, the discharge valve is a throttle valve.

The fresh water cooling loop 14 of the system 10 may be a closed fluid loop that includes a fluid pump 80 and various piping and components 84, 86, 88, 90, 92, and 94 for continuously pumping and conveying fresh water through the heat exchanger 15 and the engine 11 for cooling the engine 11 as further described below. The fresh water cooling loop 14 may further include a 3-way valve 102 that is connected to the main controller 28 via communications link 104 for controllably allowing a specified quantity of water in the fresh water cooling loop 14 to bypass the heat exchanger 15 as further described below.

A temperature in the fresh water cooling loop 14 may be measured and monitored by the main controller 28 for facilitating various control operations of the cooling system 10. Such temperature measurement may be performed by a resistance temperature detector 106 (hereinafter "RTD 106") or other temperature measurement device that is operatively connected to the fresh water cooling loop 14. The RTD 106 is shown in FIG. 1 as measuring the temperature of the fresh water cooling loop 14 on the inlet side of the engine 11, but it is contemplated that the RTD 106 may alternatively or additionally measure the temperature of the fresh water cooling loop 14 on the outlet side of the engine 11. The RTD 106 may be connected to the main controller 28 by communications link 108, or, alternatively, may be an integral, onboard component of the main controller 28.

Figure 2:
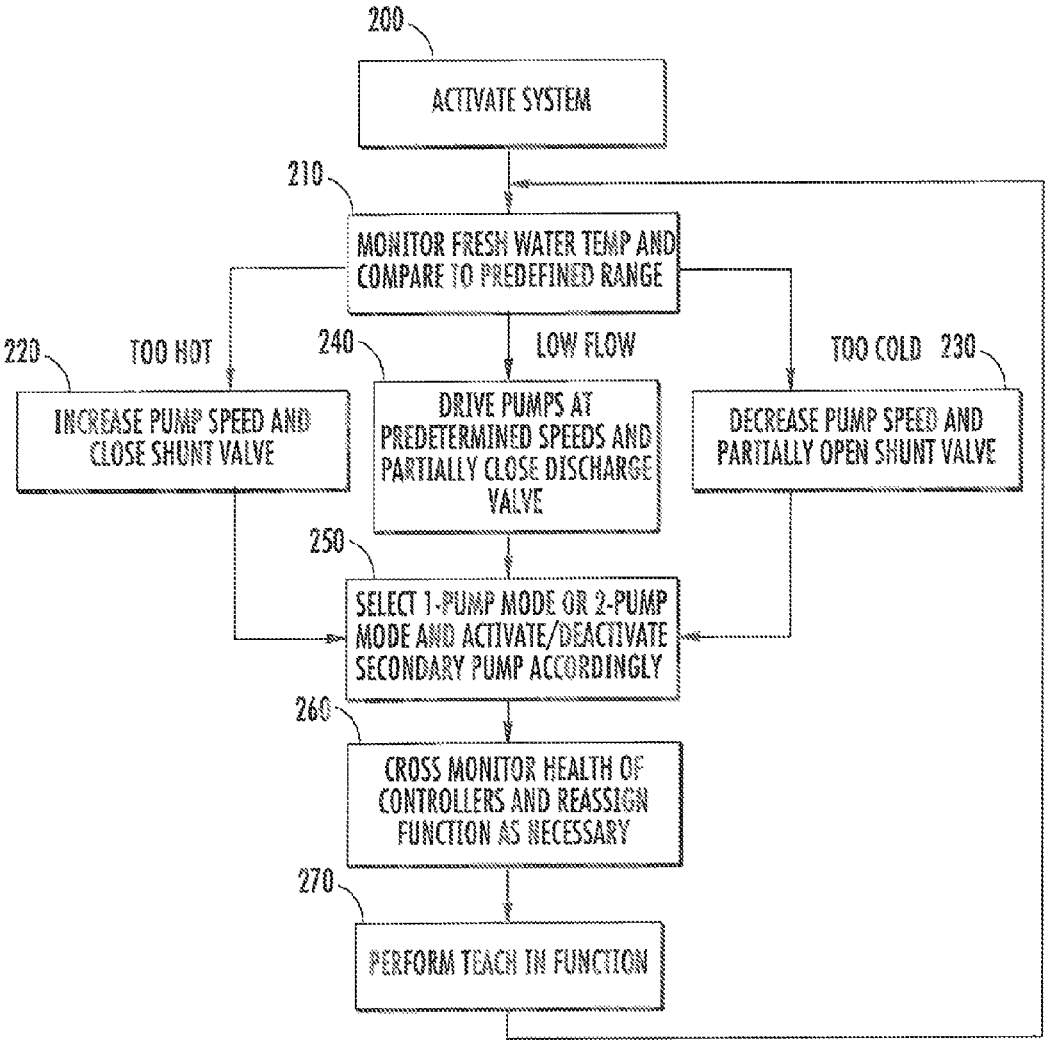
FIG. 2 is a flow diagram illustrating an exemplary general method in accordance with the present disclosure

Referring to FIG. 2, a flow diagram illustrating a general exemplary method for operating the system 10 in accordance with the present disclosure is shown. The method will be described in conjunction with the schematic representation of the system 10 shown in FIG. 1. Unless otherwise specified, the described method may be performed wholly or in part by the controllers 28-32, such as through the execution of various software algorithms by the processors thereof.

At step 200, the system 10 may be activated, such as by an operator making an appropriate selection in an operator interface (not shown) of the system 10. Upon such activation, the main and secondary controllers 28 and 30 may command the VFDs 22 and 24 to begin driving at least one of the pumps 16 and 18. The pumps 16 and 18 may thus begin pumping sea water from the sea 72, through the piping 52 and 54, through the pumps 16 and 18, through the piping 58-66, through the heat exchanger 15, and finally through the piping 68 and 70 and back to the sea 72. As the sea water flows through the heat exchanger 15, it may cool the fresh water in the fresh water cooling loop 14 that also flows through the heat exchanger 15. The cooled fresh water thereafter flows through and cools the engine 11.

At step 210 of the exemplary method, the main controller 28 may monitor the temperature of the fresh water in the fresh water cooling loop 14 via the RTD 106. The main controller 28 may thereby determine whether the fresh water is at a desired temperature for providing the engine 11 with appropriate cooling, such as by comparing the monitored temperature to a predefined temperature range. For example, the desired temperature level of the freshwater at the discharge of the heat exchanger may be 35 degrees Celsius, and the range of the temperature may be +/−3 degrees Celsius.

If the main controller 28 determines at step 210 that the monitored temperature of the fresh water exceeds, or is about to exceed, a predefined temperature level, the main controller 28 may, at step 220 of the exemplary method, increase the speed of the VFD 22 and may issue a command to the secondary controller 30 to increase the speed of the VFD 24. The corresponding main and/or secondary pumps 16 and 18 are thereby driven faster, and the flow of sea water through the sea water cooling loop 12 is increased. Greater cooling is thereby provided at the heat exchanger 15, and the temperature in the fresh water cooling loop 14 is resultantly decreased. The main controller 28 may additionally command the 3-way valve 102 to adjust its position, thereby adjusting the amount of fresh water in the fresh water cooling loop 14 through the heat exchanger 15 in order to achieve optimal cooling of the fresh water.

Conversely, if the main controller 28 determines at step 210 that the monitored temperature of the fresh water is below, or is about to fall below, a predefined temperature level, the main controller 28 may, at step 230 of the exemplary method, decrease the speed of the VFD 22 and may issue a command to the secondary controller 30 to decrease the speed of the VFD 24. The corresponding main and secondary pumps 16 and 18 are thereby driven more slowly, and the flow of sea water through the sea water cooling loop 12 is decreased. Less cooling is thereby provided at the heat exchanger 15 and the temperature in the fresh water cooling loop 14 is resultantly increased. The main controller 28 may additionally command the 3-way valve 102 to adjust its position, thereby diverting some or all of the fresh water in the fresh water cooling loop 14 to bypass the heat exchanger 15 in order to further reduce the cooling of the fresh water.

In some embodiments it may be desirable to maintain a minimum required pressure in the seawater cooling loop 12. (It will be appreciated that there are cases such minimum pressure requirements may be dictated by the demands of other connected systems, such as fire-man, sanitary, or the like.) To achieve such minimum pressure in the seawater cooling loop 12 the pumps 16, 18 may be required to operate at a speed that is not consistent with the flow required to meet the fresh water temperature target. In such a case the main controller 28 at step 240 may set a speed and activate valve 102 to assume the set temperature control.

In all cases the centrifugal pump operates at the point in which the system curve crosses the pump curve. In some embodiments the hydraulics of the pump within the seawater cooling loop 12 will not allow the pump or pumps to operate in a stable low pressure requiem or have the ability to maintain the precision required by the cooling system solely by speed control. In such case, the inclusion of a control throttling valve 89 in the seawater discharge line after the heat exchanger 15 allows extended operating range. Addition of this valve 89 can change the system curve, and its position can be adjusted, so as to control the system curve changing the operating point and extending control to a lower speed. This adjustment can enable the pumps 16, 18 to be operated at a lower speed than would normally be the case while still providing the desired low level of cooling to the fresh water loop 14. As will be appreciated, this arrangement can extend the operating range to save additional energy.

Under other circumstances, such as if the system 10 is operating in particularly cold waters and/or if the engine 11 is idling, it may be desirable to reduce the flow of sea water in the sea water cooling loop 12 to a rate below what may be achieved through the reduction of the pump speeds while maintaining stable operation of the pumps 16 and 18. That is, regardless of how little flow is required in the sea water cooling loop 12, it may be necessary to run the pumps 16 and 18 at a minimum safe operating speed to avoid cavitation or damage to the pumps 16 and 18, for example. If the main controller 28 determines that such a low flow rate of sea water is desirable, the main controller 28 may, at step 240, decrease the speed of the VFD 22 to drive the main pump 16 at or near a minimum safe operating speed, may command the secondary controller to decrease the speed of the VFD 24 to drive the secondary pump 18 at or near a minimum safe operating speed (or to shut down), and may further command the discharge valve 89 to partially close in order to maintain a required minimum system discharging pressure. By partially closing the discharge valve 89 thusly, the flow rate in the sea water cooling loop 12 may be restricted/reduced without further reducing the operational speeds of the pumps 16 and 18, and the minimum required system discharging pressure can be maintained. The pumps 16 and 18 may thereby be operated above their minimum safe operating speeds while achieving a desired low flow rate in the sea water cooling loop 12.

Figure 3:
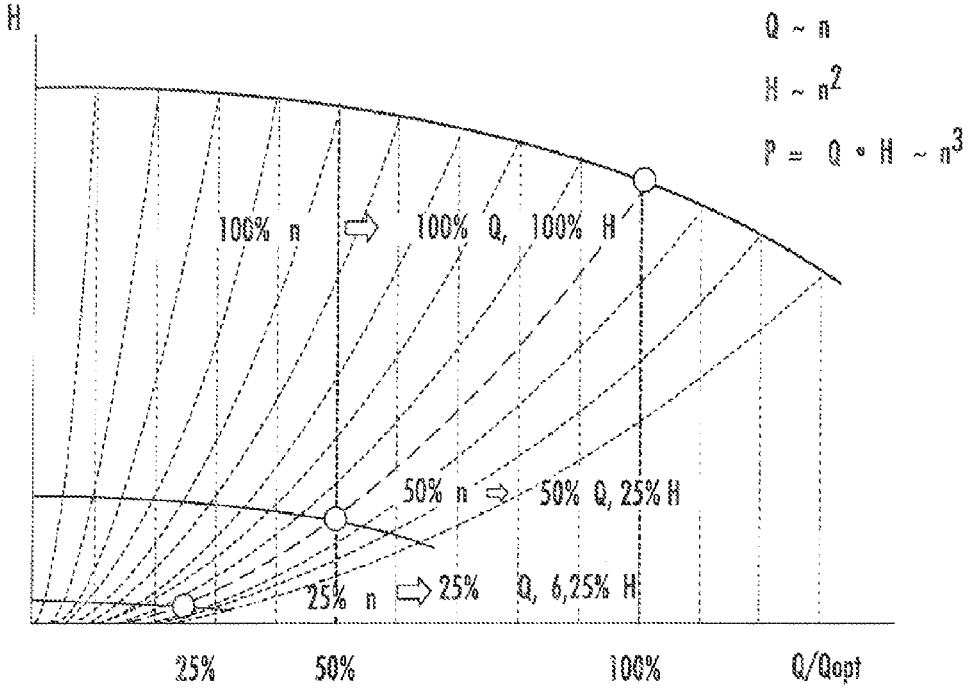
FIG. 3 is a graph illustrating energy savings as a result of reductions in pump speeds.

By continuously monitoring the temperature in the fresh water cooling loop 14 and adjusting the pump speeds and flow rate in the sea water cooling loop 12 in the manner described above, the pumps 16 and 18 may be driven only as fast as is necessary to provide a requisite amount of cooling at the heat exchanger 15. The system 10 may therefore be operated much more efficiently and may provide significant fuel savings relative to traditional sea water cooling systems in which sea water pumps are driven at a constant speed regardless of temperature variations. Such improved efficiency is illustrated in the graph shown in FIG. 3. As will be appreciated by those of ordinary skill in the art, pump power "P" is proportional to the cube of pump speed "n," while flowrate "Q" is proportional to pump speed "n." Thus, when the disclosed system 10 is operated at an optimal flow "Qopt", in lieu of running the pumps at maximum speed and simply shunting excess flow overboard or through a recirculation loop, substantial power savings can be achieved. For example, if Qopt=50% of the maximum seawater flow, then the pumps 16, 18 need only be operated at 50% of their maximum speed to provide Qopt. This reduction in speed results in a power "P" reduction of 87.5%, as compared to prior systems in which the pumps 16, 18 are operated at a constant maximum speed.

At step 250 of the exemplary method, the main controller 28 may determine whether the system 10 should be operated in a 2×100% mode or a 2-pump mode in order to achieve a desired efficiency. That is, it may be more efficient in some situations (e.g., if minimal cooling is required) to drive only one of the pumps 16 or 18 and not the other. Alternatively, it may be more efficient and/or necessary to drive both of the pumps 16 and 18 at a low speed. The main controller 28 may make such a determination by comparing the operating speeds of the pumps 16 and 18 to predefined "switch points." "Switch points" may be threshold operating speed values that are used to determine whether the system 10 should switch from 2-pump mode to 2×100% mode or vice versa. For example, if the system 10 is operating in 2-pump mode and both of the pumps 16 and 18 are being driven at less than a predetermined percentage of their maximum operating speeds, the main controller 28 may deactivate the secondary pump 18 and run only the main pump 16. Conversely, if the system 10 is operating in 2×100% mode (e.g., running only the main pump 16) and the main pump 16 is being driven at greater than a predetermined percentage of its maximum operating speed, the main controller 28 may activate the secondary pump 18.

Figure 4:
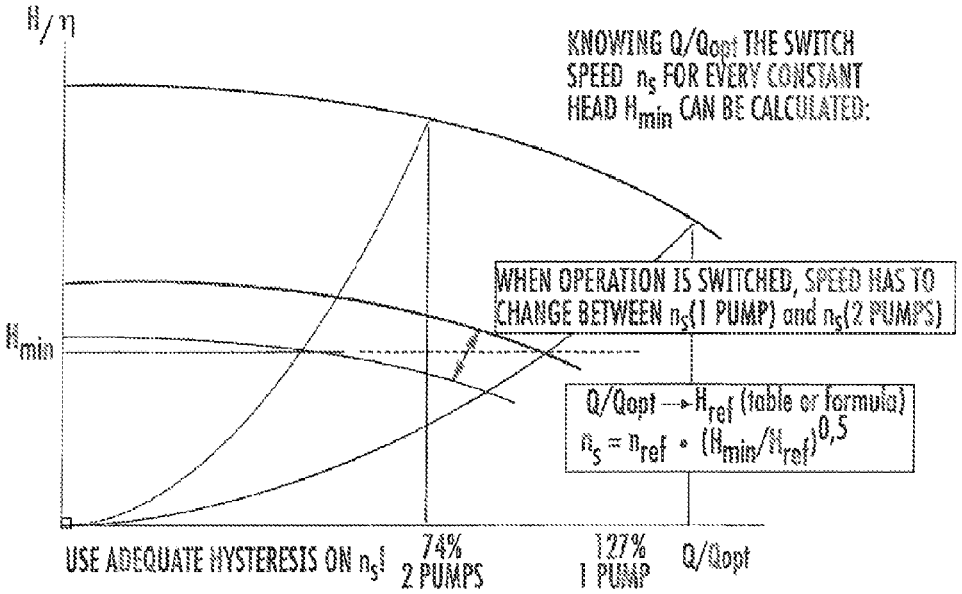
FIG. 4 is a graph illustrating exemplary means for determining whether to operate the system of the present disclosure with 1 pump or 2 pumps.

As shown in FIG. 4, The switch points (between one and two pump operation) may be determined based on the actual flow rate"Q" in the system 10 compared to optimal flow range "Qopt." According to the exemplary curve, when Q/Qopt exceeds 127% under single pump operation, the system can switch to two pump operation to operate most efficiently. Likewise, when Q/Qopt falls below 74% under two pump operation, the system can switch to single pump operation. At the same time, the discharging valve is controlled so that the required minimum system discharging pressure is maintained at all times.

At step 260 of the exemplary method, the main, secondary, and backup controllers 28, 30, and 32 may periodically transmit data packets to one another, such as via communications link 46. Such data packets may include information relating to the critical operational status, or "health," of each of the controllers 28-32 including their respective pumps 16-20 and VFDs 22-26. If it is determined that one of the controllers 28-32 has ceased to operate properly, or is trending in a direction that would indicate a near or far term malfunction, or if its communications link has malfunctioned or is otherwise inactive, the duties of that controller may, at step 260 of the exemplary method, be reassigned to another one of the controllers. For example, if it is determined that the secondary controller 30 has ceased to operate properly, the duties of the secondary controller 30 may be reassigned to the back-up controller 32. Alternatively, if it is determined that the main controller 28 has ceased to operate properly, the duties of the main controller 28 may be reassigned to the secondary controller 30 and the duties of the secondary controller 30 may be reassigned to the back-up controller 32. The system 10 is thereby provided with a level of redundancy that allows to the system 10 carry on with normal operation even after the occurrence of component failures. Of course, it will be appreciated that the system 10 may be provided with additional controllers, pumps, and VFDs if additional layers of redundancy are desired. If the ceased or questionable controller is repaired and/or restored to operational conditions, and is brought back to the operation, the information will be broadcast over the communication link to other controllers, the back-up controller will automatically stop its operation of its pump, and will be in stand-by mode for providing future needs for its back-up role.

At step 270 of the exemplary method, the main controller 28 may execute a "teach in" function, such as automatically during each startup operation and/or during its startup from restoration from a previous failure and/or ceased operation, whereby which initial operating parameters of the system can be automatically set without requiring user action. The purpose of the "teach in" function is to determine a pump operating speed necessary for ensuring that the system operates at or above a minimum pressure level, such as may be defined by an operator of a vessel.

Figure 5:
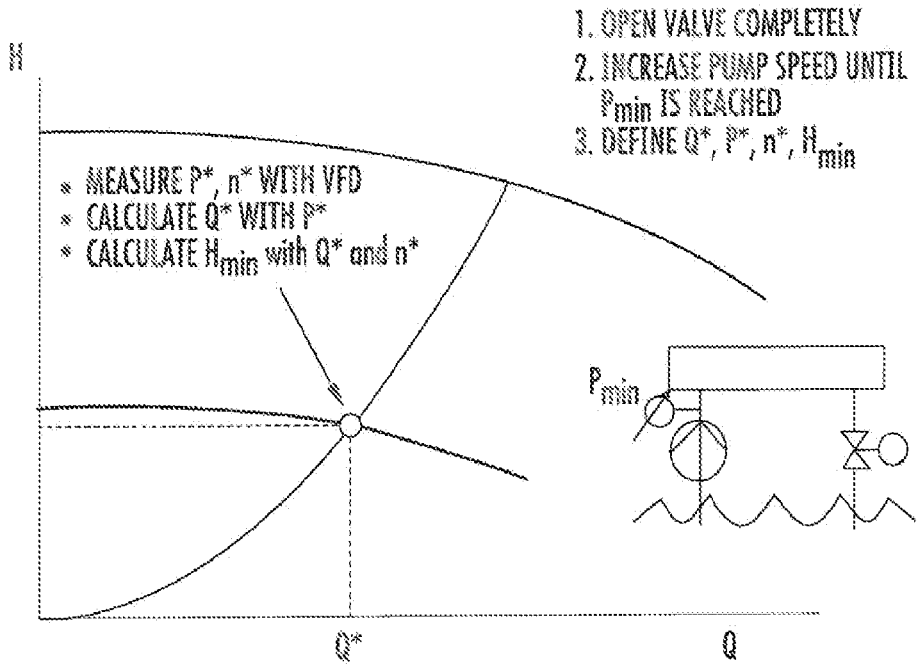
FIG. 5 a graph illustrating exemplary means for operating the system of the present disclosure at the dividing point between pump speed control for higher flow demand situations and freshwater shunt valve control for lower flow demand situation.
Figure 6:
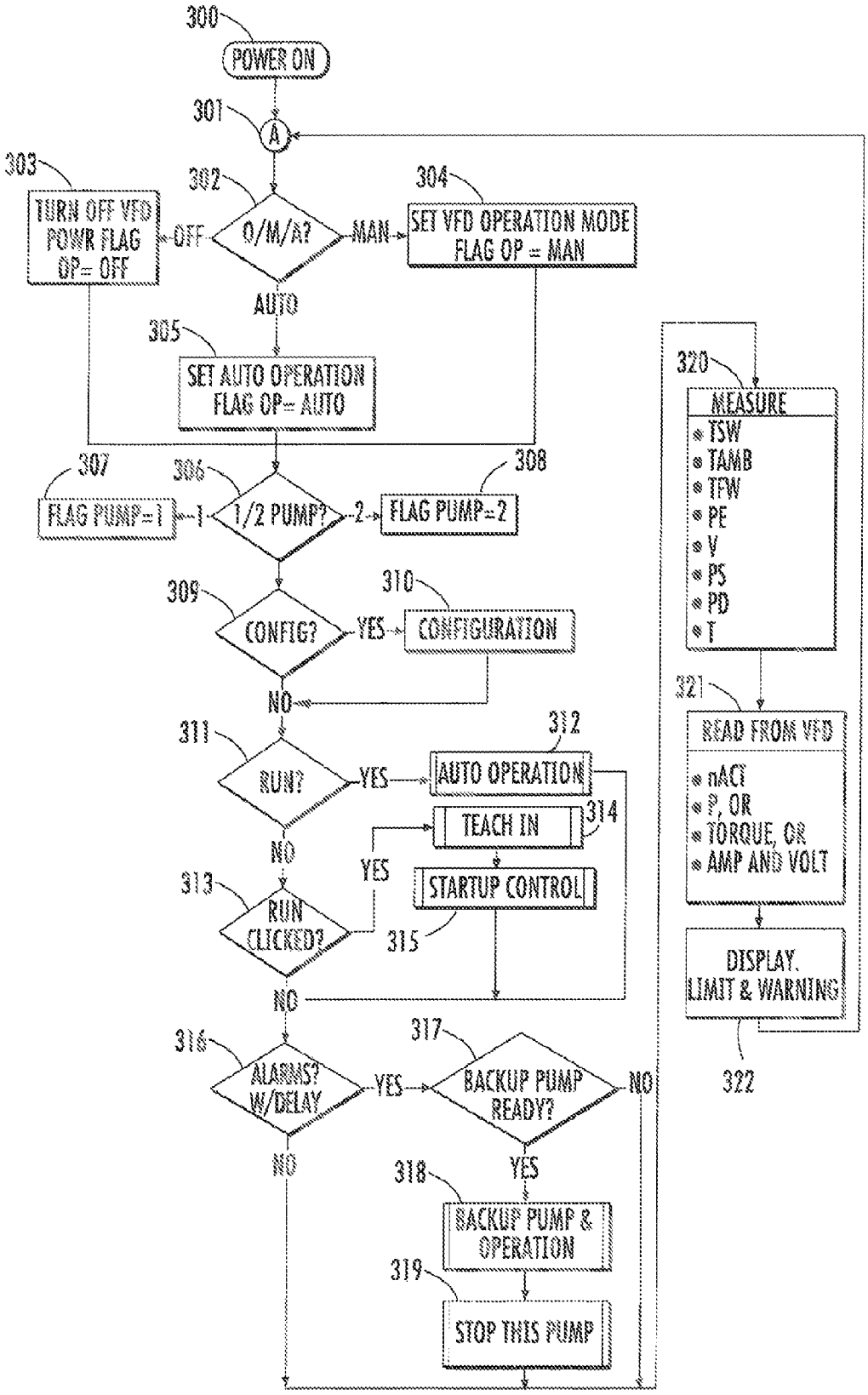
FIG. 6 is a flow diagram illustrating an exemplary detailed method in accordance with the present disclosure.
Figure 7:
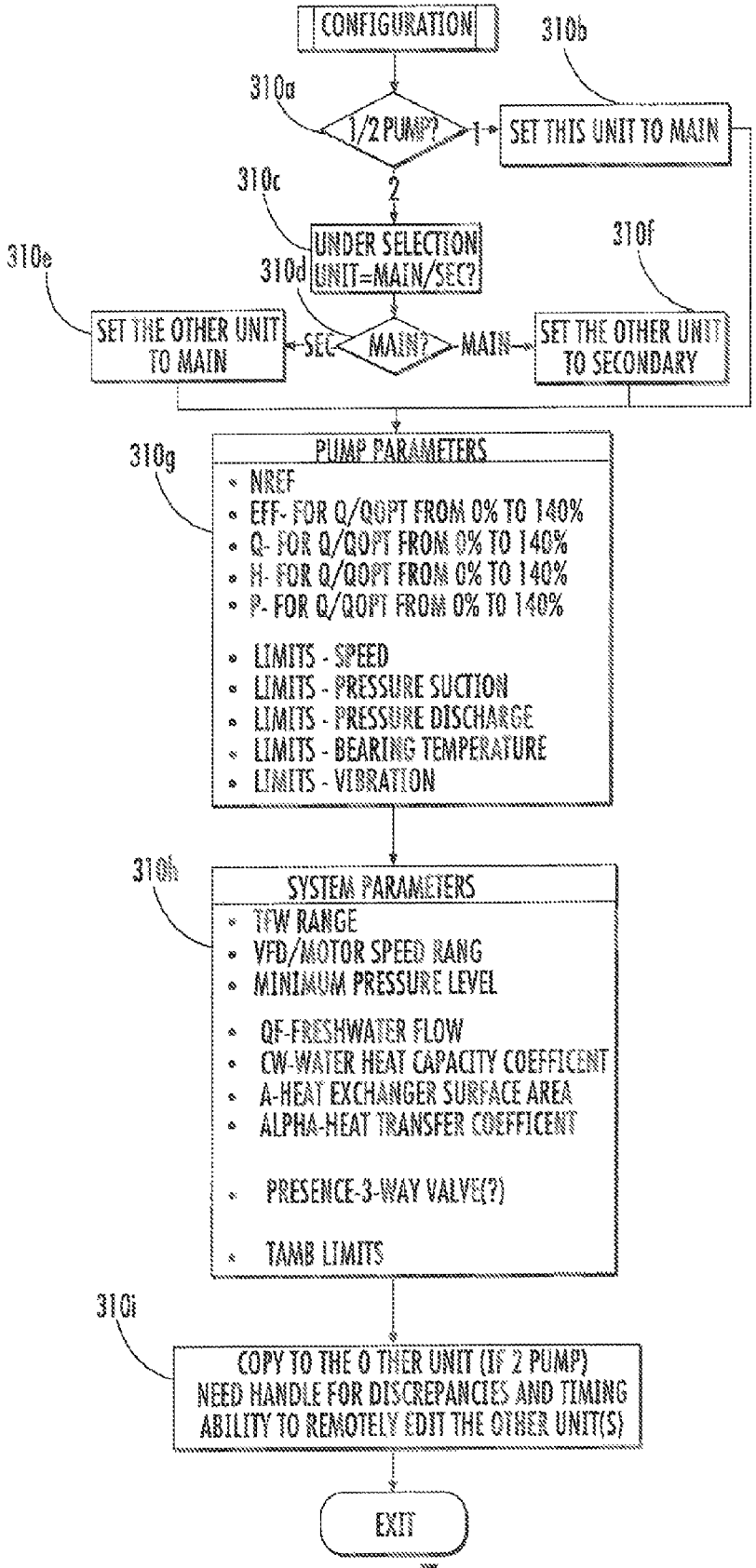
FIG. 7 is a flow diagram illustrating a configuration sub-method of the method shown in FIG. 6.
Figure 8:
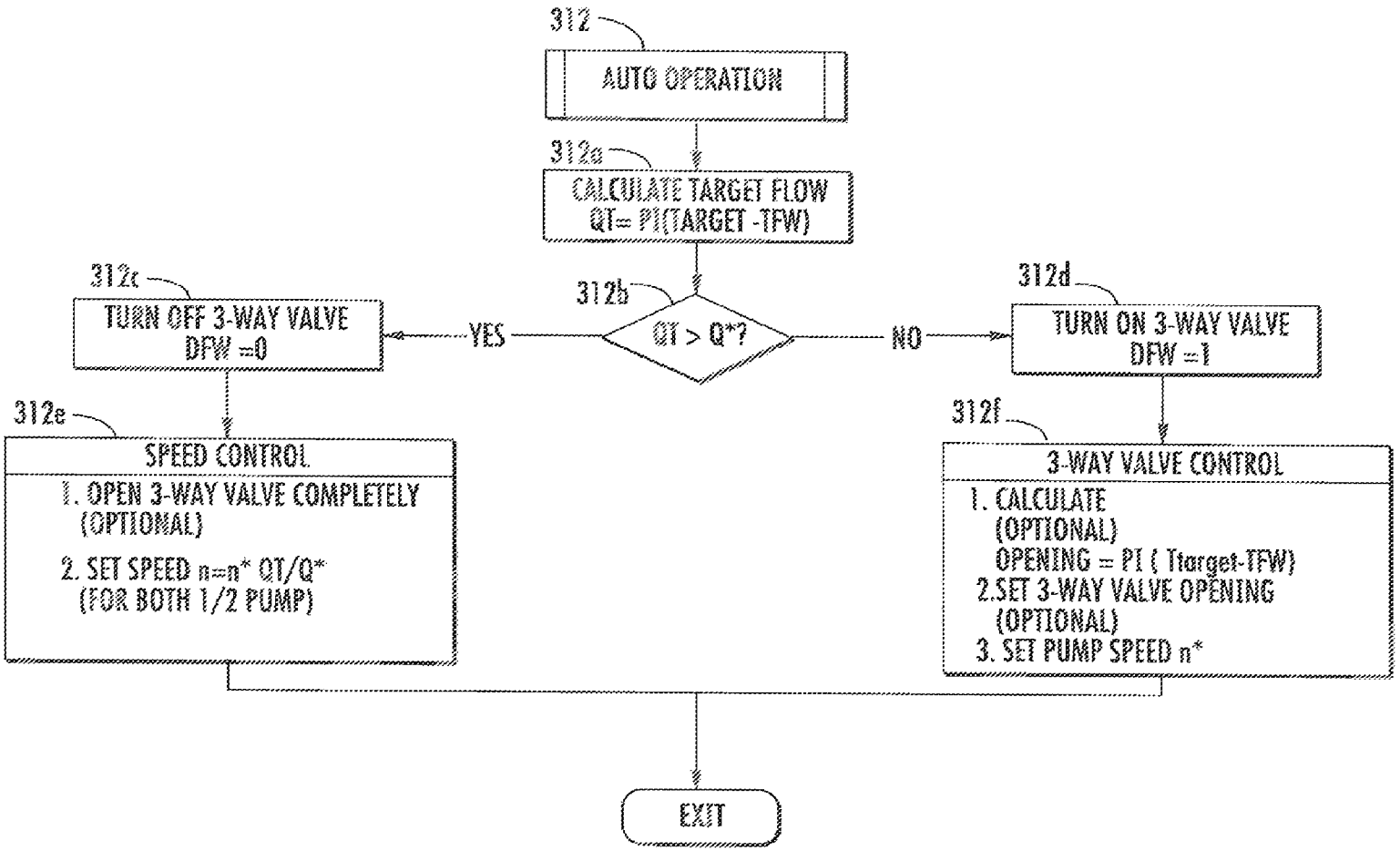
FIG. 8 is a flow diagram illustrating an auto operation sub-method of the method shown in FIG. 6.
Figure 9:
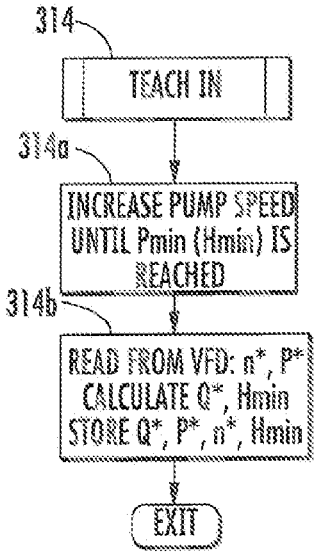
FIG. 9 is a flow diagram illustrating a teach in sub-method of the method shown in FIG. 6.

Referring to FIG. 5, as part of the "teach in" process, one or both operating pumps 16, 18 may be started with the discharge valve 89 open. Pump speed is then gradually increased until a required minimum system discharging pressure value "Pmin" (Hmin) is reached. Power "P*" and pump speed "n*" are also measured using the pump's associated VFD. These values are used to calculate a value for initial flow "Q*."

Referring to FIGS. 6-11, a series of flow diagrams illustrating a more detailed exemplary method for operating the system 10 in accordance with the present disclosure will be described. The method will be described in conjunction with the schematic representation of the system 10 shown in FIG. 1. Unless otherwise specified, the described method may be performed wholly or in part by software algorithms, such as may be executed by one or more of the controllers 28-32.

At step 300, the system 10 may be powered on, such as by an operator making an appropriate selection in a user interface (e.g., touchscreen) of one of the controllers 28 or 30. For the purposes of illustration, it will be assumed in the following description of the detailed method that the operator is interacting with a user interface of the controller 28. It will be understood, however, that the operator may instead interact with a user interface of the controller 30 in a similar manner.

At step 301, the system 10 may initially enter an automatic operation mode. At step 302, the system 10 may present an operator with an option to place the system 10 in a manual operation mode, to turn the system 10 off, or to maintain the automatic operation mode. Such an option may be presented to the operator on a display of the controller 28. If the operator selects the off option, the controller 28 may set a VFD operation mode flag to OFF at step 303. The other controllers 30 and 32 may thereby identify that the controller 28 is turned off, and the back-up controller 32 may automatically start-up for joining the operation. If the operator selects the manual operation mode, the controller 28 may set the VFD operation mode flag to MANUAL at step 304. This may cause the VFD 22 to operate the pump at a constant, predefined speed (e.g., the rated speed of the VFD 22). The manual mode may thus provide a back-up function, such as may be necessary if one or more of the controllers 28-32 malfunctions and/or automatic system operation is impaired. If the operator selects the automatic operation mode, the controller 28 may set the VFD operation mode flag to AUTOMATIC at step 305.

At step 306 of the exemplary method, the system 10 may determine whether to operate in a 2×100% mode or a 2-pump mode (as described above in relation to FIG. 4). Such a determination may be made by comparing the operating speeds of the pumps 16 and 18 to predefined "switch points." "Switch points" may be threshold operating speed values that are used to determine whether the system 10 should switch from 2-pump mode to 2×100% mode or vice versa. For example, if the system 10 is operating in 2-pump mode and both of the pumps 16 and 18 are being driven at less than 74% of their maximum operating speeds, it may be determined that the system 10 should switch to 2×100%. Conversely, if the system 10 is operating in 2×100% mode (e.g., running only the main pump 16) and the main pump 16 is being driven at greater than 127% of its maximum operating speed, it may be determined that the system 10 should switch to 2-pump mode. The switch points may be calculated based on known flow rates in the system 10 as illustrated in FIG. 4.

If it was determined in step 306 that the system 10 should operate in 2×100% mode, the controller 28 may set a pump flag to "1" at step 307. Conversely, if it was determined in step 306 that the system 10 should operate in 2-pump mode, the controller 28 may set the pump flag to "2" at step 308.

At step 309, the controller 28 may present the operator with an option to perform a configuration of the system 10. If the operator indicates that he wishes to perform configuration, such as by making an appropriate selection in the user interface of the controller 28, the controller may, at step 310, perform the configuration sub-method shown in FIG. 7. Particularly, the controller 28 may, at step 310*a* of the method, check the previously set pump flag (see step 306 in FIG. 6) to determine whether the system is operating in 2×100% mode or 2-pump mode. If the system 10 is operating in 2×100% mode, the controller 28 may, at step 310*b* of the method, designate itself as the main controller in the system 10 and the controller 30 may be assigned as a back-up controller. Alternatively, if the system 10 is operating in 2-pump mode, the controller 28 may, at steps 310*c* and 310*d* of the method, present the operator with an option to designate the controller 28 as either the main controller or the secondary controller of the system 10.

If the operator chooses to designate the controller 28 as the secondary controller in the system 10, the controller 28 may, at step 310*e*, designate the other controller 30 as the main controller in the system 10. Alternatively, if the operator chooses to designate the controller 28 as the main controller in the system 10, the controller 28 may, at step 310*f*, designate the other controller 30 as the secondary controller in the system 10. The third controller 32 will automatically be assigned as a back-up controller.

At step 310*g* of the method, the controller 28 may establish a plurality of pump parameters, such as may be provided by a pump manufacturer. Such pump parameters may include a reference speed Nref, a reference efficiency Eff for Q/Qopt in a range from 0%-140%, a reference flow Q for Q/Qopt in a range from 0%-140%, a reference head H for Q/Qopt in a range from 0%-140%, a reference pressure P for Q/Qopt in a range from 0%-140%, speed limits, suction pressure limits, discharge pressure limits, bearing temperature limits, and vibration limits.

At step 310*h* of the method, the controller 28 may establish a plurality of system parameters, such as may be provided by a vessel operator. Such parameters may include a fresh water temperature range, a VFD motor speed range, a minimum pressure level, a fresh water flow, a water heat capacity coefficient, a heat exchanger surface area, a heat transfer coefficient, presence of a 3-way valve, and ambient temperature limits.

At step 310*i* of the method, the established pump parameters and system parameters described above may be copied to the other controller 30 (i.e., if the system 10 is operating in 2-pump mode), such as by transmission through the communications link 46.

Returning to FIG. 6, after performing the above-described configuration sub-method, or if the operator chose not to perform configuration of the system 10 in step 309, the controller 28 may, at step 311 of the method, determine whether the system 10 is running under automation operation (described above). If the controller 28 determines that the system 10 is currently running under automatic operation, the controller may, at step 312, perform the auto operation and control sub-method shown in FIG. 8. Particularly, the controller 28 may, at step 312*a*, calculate a target flow rate QT for the flow of sea water in the sea water cooling loop 12. For example, QT may be calculated as the result of PI controller, PI(Ttarget-TFW), wherein Ttarget is a desired temperature level of the fresh water in the fresh water cooling loop 14 and TFW is the actual temperature of the fresh water in the fresh water cooling loop 14 as measured, for example, by RTD 106.

At step 312*b* of the method, the controller may determine whether the target flow rate QT is greater than the actual flow rate Q* in the sea water cooling loop 12. If it is determined that QT is greater than Q*, the controller 28 may, at step 312*c*, operate the 3-way valve 102 to assume a fully closed position (i.e., all freshwater flows through the heat exchanger 15). At step 312*e*, the controller 28 may adjust the speeds of the pumps 16 and 18 (or only the pump 16 if the system 10 is in 2×100% mode) at a desired speed "n" according to the equation n=n*QT/Q*, where n* is the minimum speed level at which the required minimum system discharging pressure (described above) is obtained.

Alternatively, if it is determined in step 312*b* that QT is less than Q*, the controller 28 may, at step 312*d*, operate the 3-way valve 102 to assume a partially open position to cause a certain amount of freshwater to bypass the heat exchanger 15. At step 312*f*, the controller 28 may further calculate an amount which the 3-way shunt valve 102 should be opened, such as may be given by the result of PI controller, PI(Ttarget-TFW), and may command the 3-way shunt 102 valve to open by such an amount. The controller 28 may further maintain the minimum speed n* of the pumps 16 and 18 (or only the pump 16 if the system 10 is in 2×100% mode).

If the controller 28 previously stopped the system 10 at step 311, the controller 28 may, at step 313 of the method, determine whether the system is in AUTO mode (described above). If so, the controller 28 may perform a startup process, the first step of which is to execute, at step 314, the "teach in" sub-method shown in FIG. 9. Particularly, the controller may, at step 314*a* of the method, increase the speeds of the pumps 16 and 18 (or only the pump 16 if the system 10 is in 2×100% mode) until a required minimum system discharging pressure level Pmin is reached in the sea water cooling loop 12. After Pmin is reached, the controller 28 may, at step 314*b* of the method, read a "teach in" speed n* and a teach in pressure P* from the VFDs 22 and 24 (or only the VFD 22 if the system 10 is in 2×100% mode), calculate a teach in flow Q* and a new minimum pressure level Pmin, and may store Q*, P*, n*, and Pmin. Q* can be calculated by using pump head-and-flow curve, which the pump manufacturer can provide.

Figure 10:
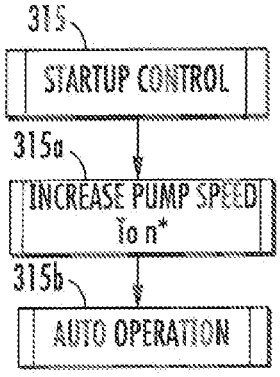
FIG. 10 is a flow diagram illustrating a startup control sub-method of the method shown in FIG. 6.
Figure 11:
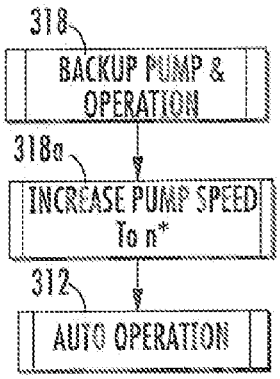
FIG. 11 is a flow diagram illustrating a backup pump & operation sub-method of the method shown in FIG. 6.
Figure 12:
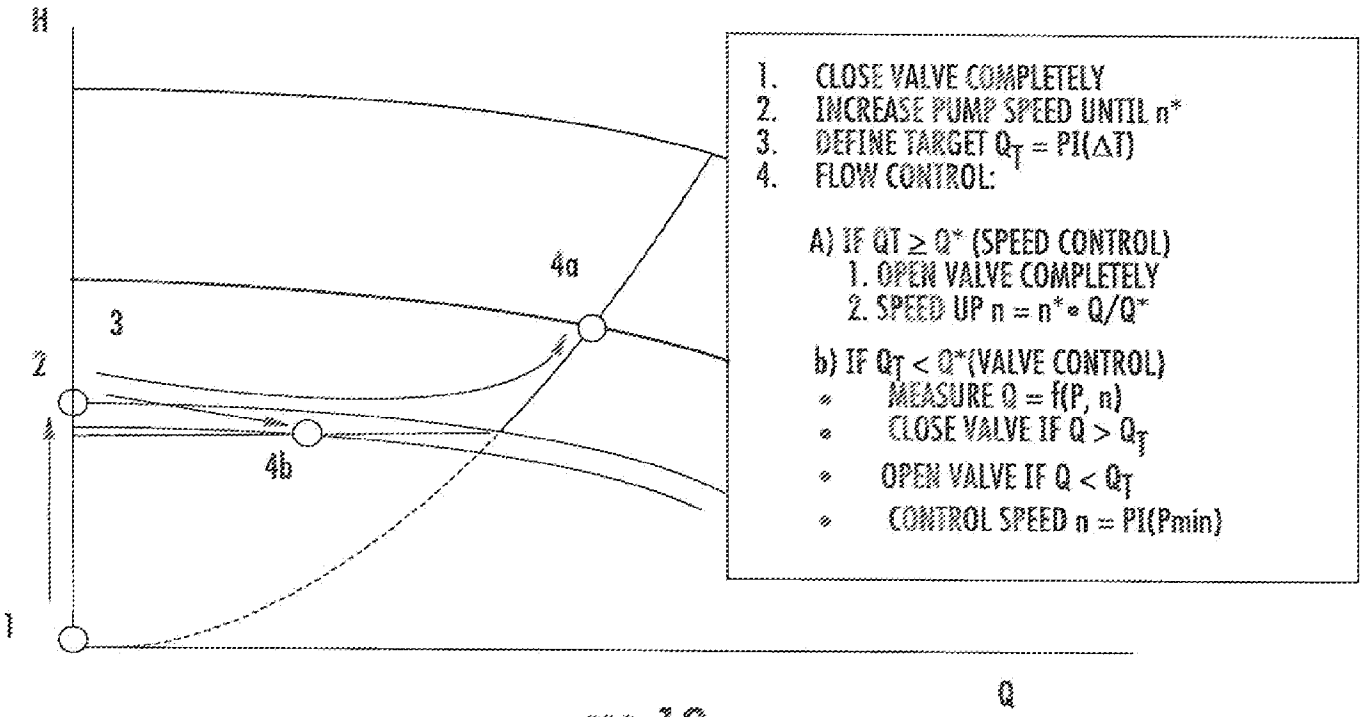
FIG. 12 is a graph illustrating the startup control sub-method shown in FIG. 9.

After performing the "teach in" sub-method, the controller 28 may, at step 315 of the method, perform the "startup control" sub-method shown in FIG. 10. Particularly, the controller 28 may, at step 315*a*, increase the speeds of the pumps 16 and 18 (or only the pump 16 if the system 10 is in 2×100% mode) to the teach-in speed level n* (also the minimum speed for the system generates the required minimum system discharging pressure). The controller 28 may then proceed to perform the auto operation sub-method of step 312 described above in relation to FIG. 8.

A after performing the above-described "auto operation" sub-method or "startup control" sub-method, or if run was not clicked in step 313, the controller 28 may, at step 316, determine whether there are any alarms in the system 10 (e.g., with predefined time delays to ensure that the alarms are not false alarms produced by transient electrical "noise"). For example, the controller 28 may determine whether either of the pumps 16 or 18 (or only the pump 16 if the system 10 is in 2×100% mode) is operating outside of the pump parameters established in the configuration sub-method described above, such as may be determined from the sensors 35, 37, and 39.

If the controller 28 determines that either of the pumps 16 or 18 is operating outside of their established parameters, the controller 28 may, at step 317 of the method (FIG. 6), determine whether the backup pump 20 is ready for operation. If it is determined that the backup pump 20 is ready for operation, the controller 28 may, at step 318, perform the backup pump & operation sub-method shown in FIG. 11. Particularly, the controller 28 may, at step 318*a*, command the controller 32 of the backup pump 20 to increase the speed of the backup pump 20 to the same speed level of the VFD 22. Finally, the controller 28 may, at step 319 of the method, stop operation of the faulty pump 16 or 18 if such operation had not ceased previously.

After step 319, or if the controller 28 determined that there were no alarms in step 316 or that the backup pump 20 was not ready in step 317, the controller may, at step 320 of the method, use the sensors 35, 37, and 39 to measure a sea water temperature TSW, an ambient temperature Tamb, a fresh water temperature TFW, a pump vibration V, a pump suction pressure PS, a pump discharge pressure PD, and a pump bearing temperature T. At step 321 of the method, the controller 28 may read from the VFDs 22 and 24 (or only the VFD 22 if the system 10 is in 2×100% mode) an actual speed nACT, a power consumption P or torque or current and voltage.

At step 322, the controller 28 may display any warnings related to operation of the pumps 16 and 18 or the system 10, and the entire method described above may be repeated starting at step 301. As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The various embodiments or components described above may be implemented as part of one or more computer systems. Such a computer system may include a computer, an input device, a display unit and an interface, for example, for accessing the Internet. The computer may include a microprocessor. The microprocessor may be connected to a communication bus. The computer may also include memories. The memories may include Random Access Memory (RAM) and Read Only Memory (ROM). The computer system further may include a storage device, which may be a hard disk drive or a removable storage drive such as a floppy disk drive, optical disk drive, and the like. The storage device may also be other similar means for loading computer programs or other instructions into the computer system.

As used herein, the term "computer" may include any processor-based or microprocessor-based system including systems using microcontrollers, reduced instruction set circuits (RISCs), application specific integrated circuits (ASICs), logic circuits, and any other circuit or processor capable of executing the functions described herein. The above examples are exemplary only, and are thus not intended to limit in any way the definition and/or meaning of the term "computer."

The computer system executes a set of instructions that are stored in one or more storage elements, in order to process input data. The storage elements may also store data or other information as desired or needed. The storage element may be in the form of an information source or a physical memory element within the processing machine.

The set of instructions may include various commands that instruct the computer as a processing machine to perform specific operations such as the methods and processes of the various embodiments of the invention. The set of instructions may be in the form of a software program. The software may be in various forms such as system software or application software. Further, the software may be in the form of a collection of separate programs, a program module within a larger program or a portion of a program module. The software also may include modular programming in the form of object-oriented programming. The processing of input data by the processing machine may be in response to user commands, or in response to results of previous processing, or in response to a request made by another processing machine.

As used herein, the term "software" includes any computer program stored in memory for execution by a computer, such memory including RAM memory, ROM memory, EPROM memory, EEPROM memory, and non-volatile RAM (NVRAM) memory. The above memory types are exemplary only, and are thus not limiting as to the types of memory usable for storage of a computer program.

The invention claimed is:

1. A variable flowrate cooling system, comprising:

a first fluid cooling loop coupled to a first side of a heat exchanger;

a second fluid cooling loop coupled to a second side of the heat exchanger and including a pump for circulating fluid through the second fluid cooling loop;

a controller operatively connected to the pump, wherein the controller is configured to monitor an actual temperature in the first fluid cooling loop and to adjust a speed of a variable frequency drive of the pump based on the monitored temperature in order to achieve a desired temperature in the first fluid cooling loop; and a temperature detector associated with the first fluid cooling loop, the controller operatively coupled to the temperature detector to receive signals representative of the temperature of the first fluid;

wherein the pump comprises a first pump and a second pump, and the controller comprises a first controller and a second controller associated with the first and second pumps, respectively;

wherein the first and second controllers are operatively coupled to communicate operational information therebetween; and wherein in response to inoperability of one of the first and second controllers, the other of the first and second controllers is configured to be reassigned duties of the inoperable first or second controller.

2. The variable flowrate cooling system of claim 1, wherein the temperature detector is positioned immediately upstream from a thermal load.

3. The variable flowrate cooling system of claim 2, wherein the thermal load is a diesel engine.

4. The variable flowrate cooling system of claim 1, wherein the second fluid cooling loop comprises a once through seawater loop.

5. The variable flowrate cooling system of claim 4, wherein the first fluid cooling loop comprises a closed freshwater loop.

6. The variable flowrate cooling system of claim 1, wherein the controller is configured to drive the pump at a speed for providing requisite cooling of the heat exchanger in the first fluid cooling loop based on the speed of the pump and the detected temperature, and to command operation of a second pump at predefined switch points for switching operation between a single pump and more than one pump.

7. The variable flowrate cooling system of claim 1, wherein the controller is configured to drive the pump at a speed for providing requisite cooling of the heat exchanger in the first fluid cooling loop based on the speed of the pump and the detected temperature, and to command operation of a second pump at predefined switch points for switching operation between a single pump and more than one pump.

8. A method for providing variable sea water cooling flow to a heat exchange element, the method comprising:

circulating a first fluid in a first cooling loop at a first flow rate, the first cooling loop coupled to a first side of a heat exchanger;

circulating a second fluid in a second cooling loop at a second flow rate, the second cooling loop coupled to a second side of the heat exchanger;

detecting a temperature of the first fluid; and adjusting the second flow rate to maintain a temperature of the first fluid within a predetermined temperature range;

wherein the pump comprises a first pump and a second pump, and the controller comprises a first controller and a second controller associated with the first and second pumps, respectively;

wherein the first and second controllers are operatively coupled to communicate operational information therebetween; and wherein in response to inoperability of one of the first and second controllers, the other of the first and second controllers is configured to be reassigned duties of the inoperable first or second controller.

9. The method of claim 8, wherein the temperature is detected immediately upstream from a thermal load.

10. The method of claim 9, wherein the thermal load is a diesel engine.

11. The method of claim 9, wherein the second fluid is seawater, and the step of circulating the second fluid comprises operating a pump at a variable speed to adjust the second flow rate.

12. The method of claim 11, wherein adjusting the flow rate is performed using a controller associated with the pump.

* * * * *